US008141862B2

(12) United States Patent
Motoyoshi

(10) Patent No.: US 8,141,862 B2
(45) Date of Patent: Mar. 27, 2012

(54) SHEET POST-PROCESSING APPARATUS AND IMAGE FORMING SYSTEM

(75) Inventor: Tomoya Motoyoshi, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 208 days.

(21) Appl. No.: 12/617,923

(22) Filed: Nov. 13, 2009

(65) Prior Publication Data

US 2010/0123279 A1 May 20, 2010

(30) Foreign Application Priority Data

Nov. 18, 2008 (JP) ..... JP2008-294197

(51) Int. Cl.
*B65H 37/04* (2006.01)

(52) U.S. Cl. ..... 270/58.09; 270/58.02; 270/58.07; 270/58.08

(58) Field of Classification Search ..... 270/58.02, 270/58.07, 58.08, 58.09
See application file for complete search history.

(56) References Cited

U.S. PATENT DOCUMENTS

| | | | | |
|---|---|---|---|---|
| 5,573,233 | A * | 11/1996 | Hirai et al. | 270/58.08 |
| 6,220,592 | B1 * | 4/2001 | Watanabe et al. | 271/241 |
| 6,661,995 | B2 * | 12/2003 | Isobe et al. | 399/410 |
| 7,500,667 | B2 * | 3/2009 | Miyazaki et al. | 271/189 |
| 7,510,177 | B2 * | 3/2009 | Nagata et al. | 270/58.08 |
| 2008/0315507 | A1 * | 12/2008 | Iguchi et al. | 271/225 |

FOREIGN PATENT DOCUMENTS

| | | |
|---|---|---|
| JP | 10-129920 | 5/1998 |

* cited by examiner

*Primary Examiner* — Leslie A Nicholson, III
(74) *Attorney, Agent, or Firm* — Finnegan, Henderson, Farabow, Garrett & Dunner, L.L.P.

(57) ABSTRACT

A sheet post-processing apparatus including: an open-close door; a stapler which executes a staple processing to a bundle of sheets; a staple jam detection section which detects a staple jam; a stapler moving section which moves the stapler to an access position disposed close to the open-close door; a stacker which holds the bundle of sheets to be stapled; a sheet sensor which detects whether a sheet exist on the stacker; and a controller which controls the stapler moving section, wherein when the staple jam detection section detects a staple jam, the controller controls to operate the stapler moving section to move the stapler from a home position to the access position, and wherein, when the sheet sensor detects the sheet on the stacker, the controller prohibits to move the stapler to the access position.

7 Claims, 12 Drawing Sheets

SHEET POST-PROCESSING APPARATUS AND IMAGE FORMING SYSTEM

CROSS REFERENCE TO RELATED APPLICATION

The present application is based on Japanese Patent Application No. 2008-294197 filed with Japanese Patent Office on Nov. 18, 2008, the entire content of which is hereby incorporated by reference.

BACKGROUND OF THE INVENTION

1. Technical Field

The present invention relates to a sheet post-processing apparatus having a stapler that bundles a plurality of sheets and an image forming system provided with the sheet post-processing apparatus.

2. Background Art

The stapler is a processing apparatus for bundling sheets using a binding staple.

In the sheet post-processing apparatus having a stapler, there is a case in which the binding staple is not properly punched from the stapler, namely, a staple jam occurs.

In case when the staple jam occurs, the staple jam is detected, an operator is notified of the necessity to clear the staple jam, and the apparatus stops.

The operator removes a bundle of sheets that is loaded on a stacker and being under a binding process. The operator also accesses the stapler to remove a staple that is remaining without being properly punched. Thus, the staple jam is cleared and a process is resumed.

Conventionally, there is a mechanism that enables the operator to access the stapler to clear the staple jam. This mechanism is disclosed in Unexamined Japanese Patent Application Publication No. H10-129920, (Patent Document 1).

In the Patent Document 1, a stapler unit includes a stacker for stacking a sheet onto which a binding process is performed, an aligning device for aligning the sheet on the stacker and a stapler. The mechanism is configured so that the above mentioned stapler unit can be pulled out of the sheet post-processing apparatus to clear the staple jam.

In the Patent Document 1, the stapler unit is pulled out from the main body of the apparatus at the time of the occurrence of the staple jam. Since the unit pulled out has a large capacity, a large workspace is required for clearing the staple jam. In other words, a substantial occupation area of the sheet post-processing apparatus becomes large.

In a system in which the post-processing apparatus is arranged on the left-hand side of an image forming apparatus, a home position of the stapler is generally arranged on the far side of the post-processing apparatus by taking into consideration of the moving distant of the stapler at the time of stapling at the left corner of the sheet to be discharged face-down.

Therefore, in order to pull out the stapler being evacuated to the home position to a near side position where the operator can access to clear the staple jam, it is necessary to pull the stapler unit farther out from the apparatus main body. Thus, the workspace for clearing the staple jam becomes very large.

Since the unit pulled out becomes large-sized, the structure for pulling the unit out also becomes large. Thus, the apparatus becomes large and the cost increases.

SUMMARY

An aspect of the present invention will be as follows.

1. A sheet post-processing apparatus including: an open-close door arranged to be capable of being opened and closed; a stapler which executes a staple processing to a bundle of sheets; a staple jam detection section which detects a staple jam where a staple is not properly punched out from the stapler; a stapler moving section which moves the stapler to an access position disposed close to the open-close door; a stacker which holds the bundle of sheet to be stapled; a sheet sensor which detects at least whether a sheet exist on the stacker; and a controller which controls the stapler moving section, wherein when the staple jam detection section detects a staple jam and the sheet sensor detects that there is no sheet on the stacker, the controller controls to operate the stapler moving section to move the stapler from a home position to the access position, and wherein, when the staple jam detection section detects a staple jam and the sheet sensor detects the sheet on the stacker, the controller prevents the stapler from moving to the access position.

2. The sheet post-processing apparatus of item 1, wherein the home position of the stapler is set on a far side of an apparatus which is an opposite side of the open-close door with respect to the access position.

3. The sheet post-processing apparatus of item 1, further including an open-close sensor for detecting an opening and a closing of the open-close door, wherein the controller operates the stapler moving device to move the stapler to the access position upon a condition where the open-close sensor detects that the open-close door has been opened and thereafter closed.

4. The sheet post-processing apparatus of item 3, wherein in a condition that the stapler is set to the access position, when the open-close sensor detects the opening and thereafter the closing of the open-close door, the controller determines that staple jam has been cleared, and clears a staple jam state.

5. The sheet post-processing apparatus of item 1, further including a cartridge attachment and detachment sensor for detecting attachment and detachment of a staple cartridge of the stapler, the control device clears a staple jam state when the cartridge attachment and detachment sensor detects detachment and attachment of the staple cartridge.

6. The sheet post-processing apparatus of item 3, wherein the controller controls the stapler moving section to stop the stapler when the opening of the open-close door is detected while the stapler is being moved by the stapler moving section, and after stopping the stapler, the controller controls the stapler moving section to move the stapler to the access position when the closing of the open-close door is detected by the open-close sensor.

7. An image forming system including: an image forming apparatus for forming an image on a sheet; and the sheet post-processing apparatus of item 1 for executing staple processing to the bundle of sheets containing a plurality of sheets on which the image forming apparatus has formed images.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Hereafter, the present invention will be described based on an embodiment of the present invention. However, the present invention is not limited to this embodiment.

[Image Forming System]

Figure 1:
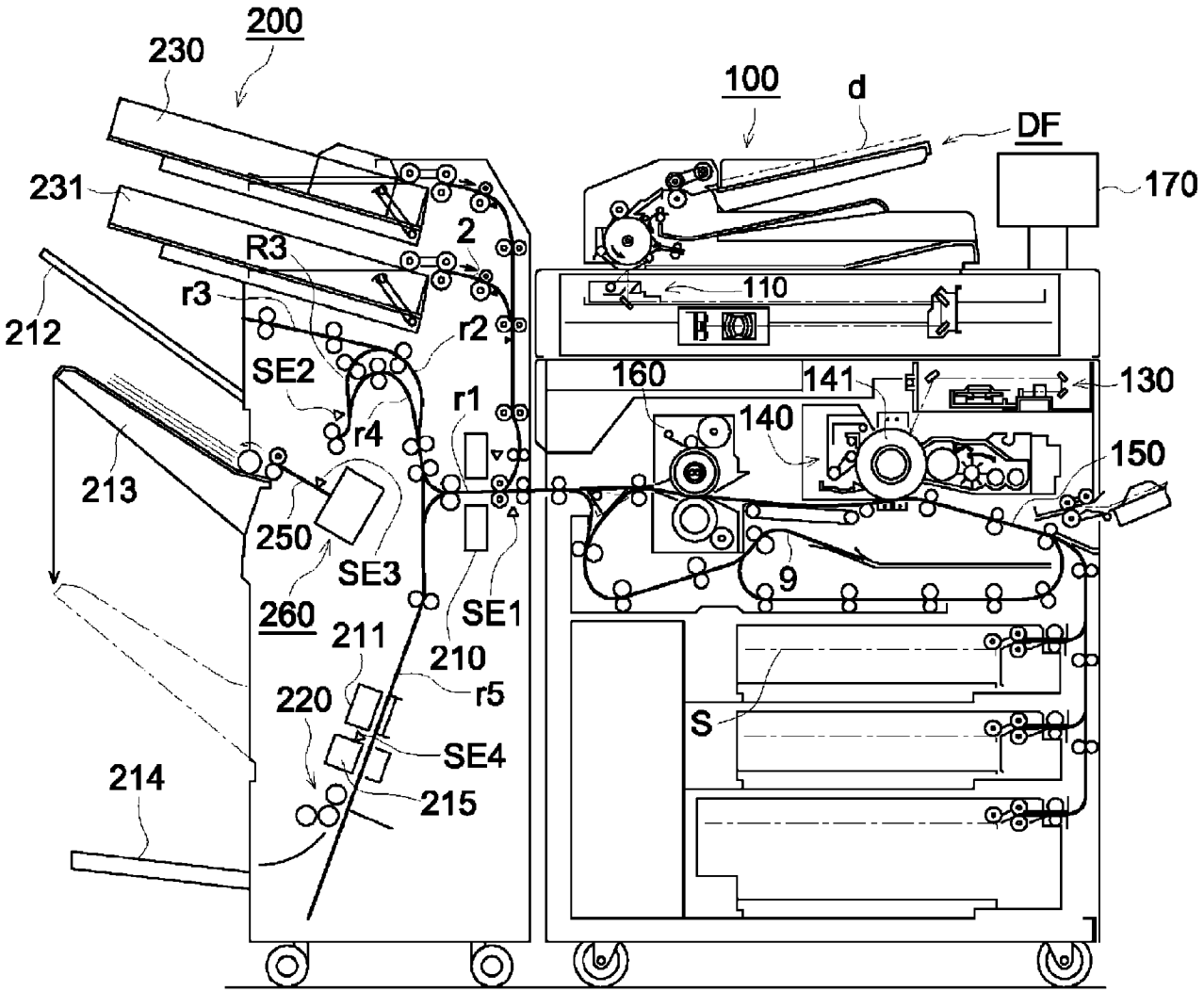
FIG. 1 illustrates an entire configuration of an image forming system in which a sheet post-processing apparatus 200 pertaining to an embodiment of the present invention is connected to an image forming apparatus 100.

FIG. 1 illustrates an entire configuration of an image forming system in which a sheet post-processing apparatus 200 pertaining to an embodiment of the present invention is connected to an image forming apparatus 100.

The image forming apparatus 100 is configured by a document reading section 110, an image writing section 130, an image forming section 140, a sheet feed conveyance section 150, a fixing section 160 and an operation display section 170.

The operation display section 170 functions as an input section for the operator to input job information for operating the image forming apparatus 100 and the sheet post-processing apparatus 200, which is connected to the image forming apparatus.

Following selections may be inputted as the job information from the operation display section 170: a selection of a size and a number of sheets, which is necessary information for operating the image forming apparatus 100, a selection of whether to perform a binding, which is necessary information for operating the sheet post-processing apparatus 200 connected to the image forming apparatus 100, further, in case of executing the binding, a selection of whether to perform a two-center binding, a corner binding B or a corner binding C, a number of sheets of the paper to be bound in one booklet, and a number of the booklets to be formed. The operation display section 170 includes a start button. An operation based on the job information of the image forming apparatus 100 and the sheet post-processing apparatus 200 inputted to the operation display section 170 can be started when the operator presses the start button.

An image forming apparatus controller (not illustrated) controls the entire image forming system while controlling an image formation operation of the image forming apparatus 100 based on the job information, which includes information on a binding specified by the operator inputted from the operation display section 170.

An automatic document feeder DF is mounted on the upper section of the image forming apparatus 100. A document "d" placed on a document platen of the automatic document feeder DF is conveyed in the direction of an arrow. An optical system of a document reading section 110 reads an image on the document. Then image information is acquired.

The image information acquired by the image reading and the image information received from outside are sent to an image writing section 130 after necessary image processing has been performed.

In the image writing section 130, an output beam of a semiconductor laser based on the image information is irradiated onto a photoreceptor drum 141 of the image forming section 140, and a latent image is formed on the photoreceptor drum 141. In the image forming section 140, image formation by an electrophotography process, such as charging, exposure and development, is performed, and an image of the toner image formed onto the photoreceptor drum 141 is transferred onto a sheet "S" conveyed by the sheet feed conveyance section 150.

The fixing section 160 fixes the transferred image onto the sheet "S". Then the sheet "S" is discharged.

The sheet post-processing apparatus 200 includes a puncher 210 for punching a hole on a prescribed position of the sheet, a stacker 250, a stapler 260 for performing a side stitch, a stapler 317 for performing a saddle stitch and a folding roller 220 for performing a fold.

The sheet post-processing apparatus 200 also includes sheet storage sections 230 and 231 for storing the sheet sent from the image forming apparatus 100 and the sheet used for a cover or a partition.

The sheet post-processing apparatus 200 includes a fixed sheet discharge tray 212 in the upper section, an ascend and descend sheet discharge tray 213 and a fixed sheet discharge tray 214 in the lower section as sheet discharge trays onto which a sheet discharged from the sheet post-processing apparatus 200 is loaded.

The fixed sheet discharge tray 212 is used for a job for forming an image onto a few pieces of sheets.

The ascend and descend sheet discharge tray 213 is used for a job for forming an image onto a large quantity of sheets and for a side stitch job.

The fixed sheet discharge tray 214 is used for the saddle stitch job.

"211" is an aligning member for aligning a sheet onto which the saddle stitch is performed.

The sheet post-processing apparatus 200 includes sheet sensors SE1, SE2, SE3 and SE4, which detect the sheet at a various positions.

SE1 detects the sheet "S" within a sheet introduction section of the sheet post-processing apparatus 200.

SE2 detects the sheet "S" discharged from conveyance paths r2 and r3 to the stacker 250.

SE3 detects the existence of the sheet "S" on the stacker 250.

SE4 detects the existence of the sheet "S" in a saddle stitch section.

The sheet "S" sent in from the image forming apparatus 100 is discharged to the fixed sheet delivery tray 212 through conveyance paths r1 and r2.

The sheet "S" is sent to the stacker 250 through a conveyance path r3 or r4 from the conveyance path r1. The conveyance paths r3 and r4 alternately accept the sheet "S" that is continuously sent. Then the sheet "S" is discharged to the stacker 250 in a bundle of two sheets. A process of sheet feeding a subsequent sheet can be performed while performing a stapling process to a preceding bundle of sheets without a delay when the sheet "S", which is continuously discharged from the image forming apparatus 100 at high speed, is processed using a conveyance path r3 and a conveyance path.

After a plurality of sheets "S" has been accumulated on the stacker 250, the plurality of sheets "S" is stapled by the stapler 260 and is discharged to the ascend and descend sheet discharge tray 213.

Further, the sheet "S" is sent to the stapler 215 through conveyance paths r1 and r5. The stapler 215 performs the saddle stitch to the sheet "S". Then the sheet "S" is discharged onto the fixed sheet discharge tray 214.

The sheet "S" discharged from the image forming apparatus 100 is put into a bundle of sheets. Then a staple for binding is put through the bundle of sheets. Hereby a binding process can be performed.

Figure 7A:
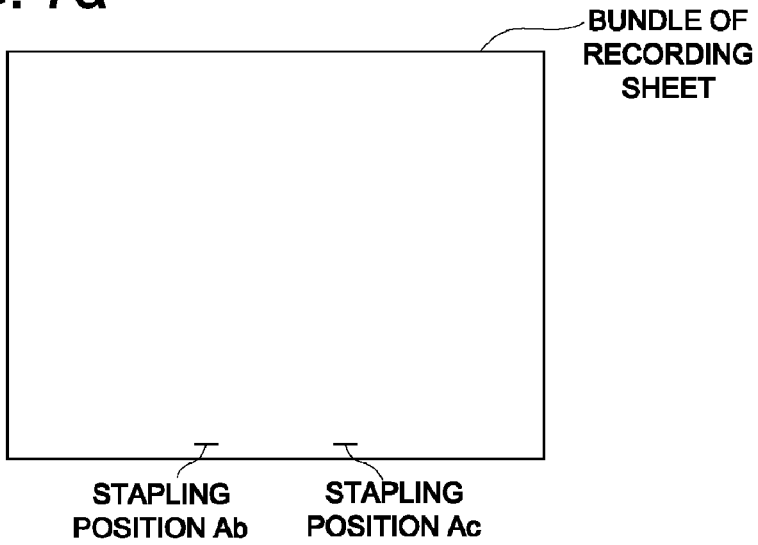
FIGS. 7*a*-7*c* illustrate a stapling position on a sheet.
Figure 7B:
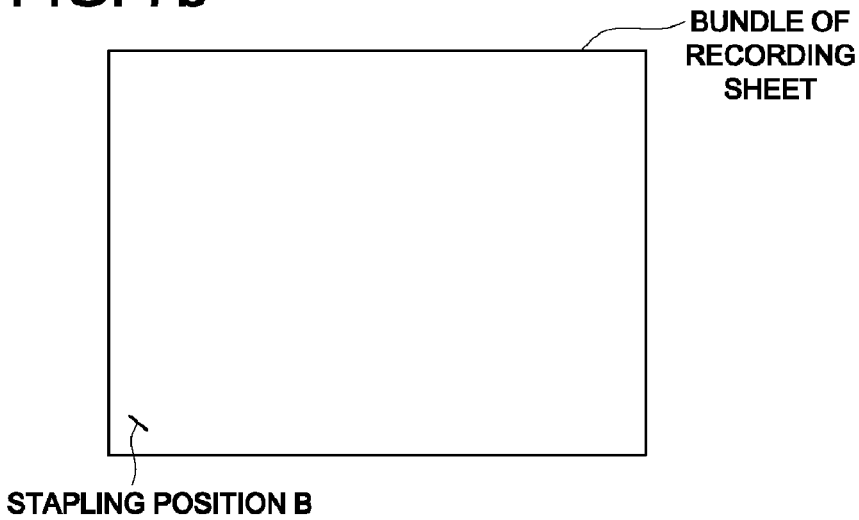
Figure 7C:
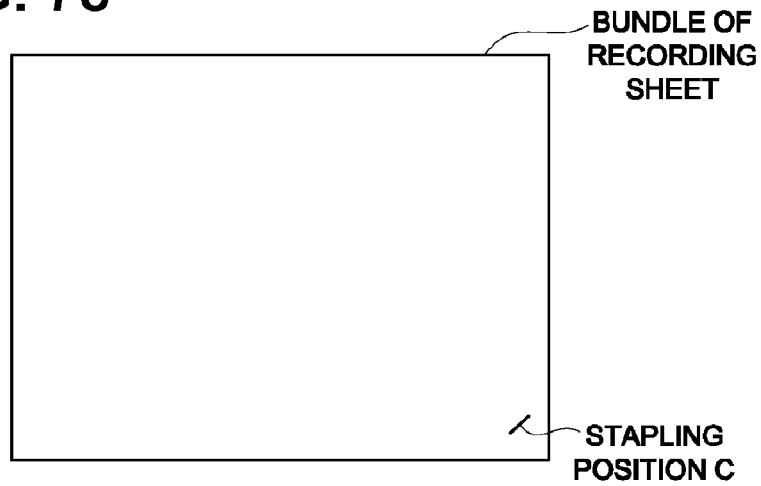

The sheet post-processing apparatus 200 performs the following three kinds of bindings illustrated in FIG. 7: a two-center binding, a corner binding B and a corner binding C.

In case when performing the binding to the sheet "S" acquired from the image forming apparatus 100, a predetermined number of the acquired sheet "S" is loaded onto the stacker 250 and a bundle of sheets Ss is formed. Then the stapler 260 is moved to a binding processing position set by the operator. Then a stapling is performed. A booklet to which the binding has been performed is formed. Then the booklet is discharged to the ascend and descend sheet discharge tray 213.

The sheet post-processing apparatus 200 is capable of being arranged not to perform the binding process to the sheet "S" acquired from the image forming apparatus 100. In case when the binding process is not performed, the acquired sheet "S" is directly discharged to the ascend and descend sheet discharge tray 213.

A selection by the operator on whether to perform the binding or not and on the binding position in operating the sheet post-processing apparatus 200 is inputted from the operation display section 170 of the image forming apparatus 100 and is transmitted to the sheet post-processing apparatus 200 from the image forming apparatus 100 as job information.

In case when the corner binding B is selected, a specified stapling position of the stapler 260 is set at a stapling position B. In the similar manner, in case when the corner binding C is selected, a stapling position of the stapler 260 is set at a stapling position C.

In case when the two-center binding is selected, the stapling position of stapler 260 is at two places of a stapling position Ab and a stapling position Ac.

In case when the binding process is not performed to the sheet "S", the sheet "S" is accepted by an entrance conveyance path r1 and is led to a sheet delivery conveyance path r3. Then the sheet "S" is discharged and loaded onto the fixed sheet discharge tray 212.

Further, in case when the binding process is performed, the sheet "S" is led to the binding conveyance paths r3 and r4, and is conveyed to the stacker 250.

The sheet "S" conveyed to the conveyance paths r3 and r4 is discharged to the upper space of the stacker 250 arranged in inclinations. In case when the last sheet of the bundle of sheets is discharged from the image forming apparatus 100 and is loaded onto a sheet loading side 250S, the stapler 260 performs the stapling to the bundle of sheets Ss. Then the booklet is formed.

The formed booklet is discharged and loaded onto the ascend and descend sheet discharge tray 213.

[Staple Section]

Figure 2:
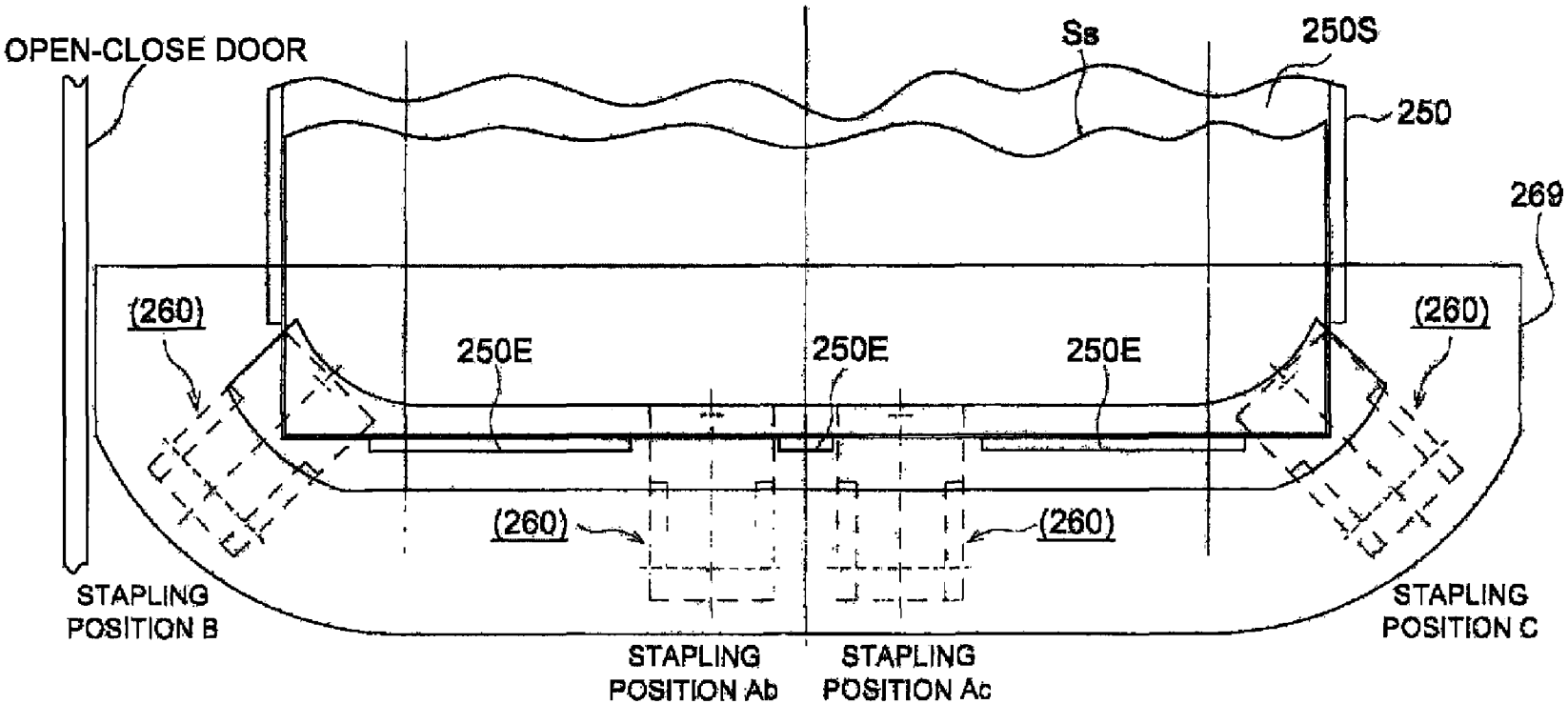
FIG. 2 illustrates a top view of a base (lower right end of a stacker 250 in FIG. 1) of the stacker 250.
Figure 3A:
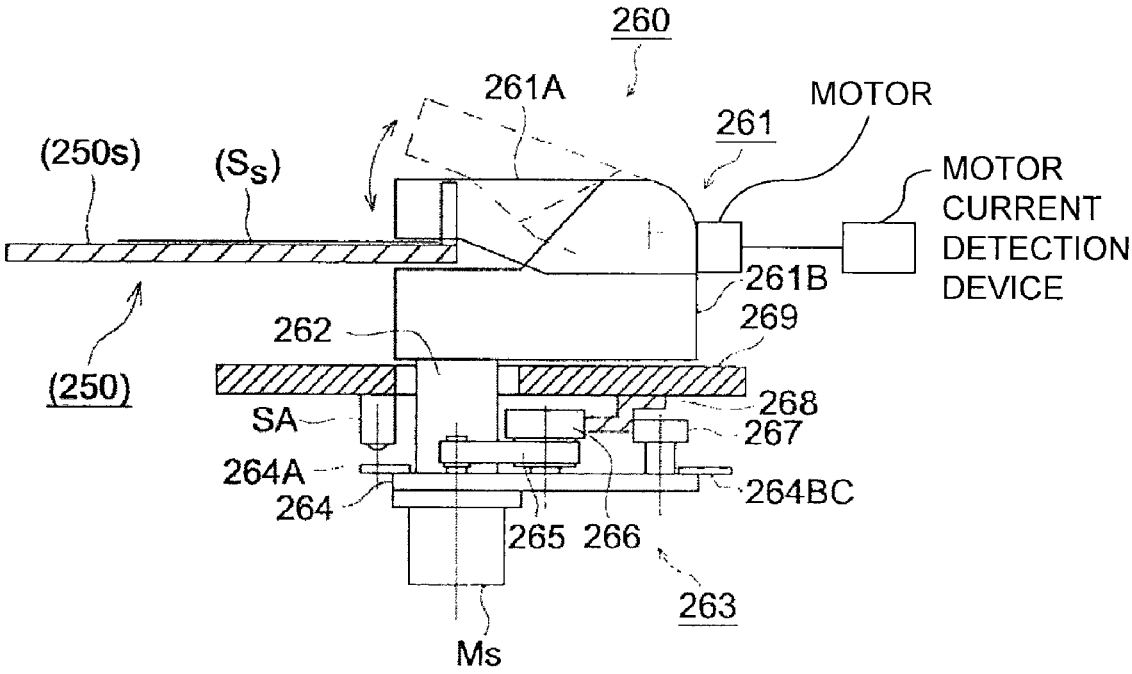
FIGS. 3*a*-3*b* illustrate a configuration of a stapler 260.
Figure 3B:
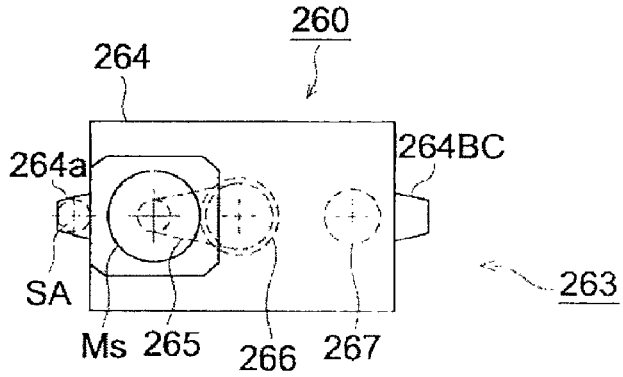

FIG. 2 illustrates a top view of a base (lower right end of the stacker 250 in FIG. 1) of the stacker 250. FIGS. 3*a*-3*b* illustrate a configuration of the stapler 260.

The stapler 260 is capable of moving along a peripheral of the stacker 250, concretely, along a sheet rear edge stopper 250E.

As illustrated in FIG. 7, the stapler 260 is capable of performing the two-center binding indicated by Ab and Ac, the corner binding B and the corner binding C to the bundle of sheets Ss loaded on the stacker 250.

The stapler 260 is configured by a stapling mechanism section 261, a moving mechanism section 263 and a connecting member 262 for connecting the stapling mechanism section 261 and the moving mechanism section 263. The stapling mechanism section 261 and the moving mechanism section 263 are arranged to sandwich a stapler holding substrate 269 from front and back, and are arranged to move along the surface of the stapler holding substrate 269. The stapler holding substrate 269 is fixed to the sheet post-processing apparatus 200 so as to be parallel with the sheet loading side 250S of the stacker 250. The stapler 260 moves in parallel with the surface of the bundle of sheets Ss loaded on the stacker 250. The stapler 260 can be moved to a stapling position (predetermined position) at which the binding selected by the operator is capable of being executed.

The stapling positions of the stapler 260 are illustrated in FIG. 2. The stapler 260 is arranged in parallel with a surface of the stapler holding substrate 269. The stapler 260 is also arranged to move along the sheet rear end stopper 250E of the stacker 250. The stapler 260 can be moved to stapling positions B, Aa, Ac and C as a plurality of predetermined positions illustrated.

The home position of the stapler 260 is at the stapling position C. The stapling position C is disposed on the far side of the sheet post-processing apparatus.

The stapler 260 moves from the stapling position C which being the home position, into a conveyance cross direction that is orthogonal to the direction to which the sheet is conveyed. Then the stapler 260 is set to the stapling positions Ac, Ab or B.

The corner binding B is performed when the stapler 260 executes a stapling at the stapling position B. In the similar manner, the corner binding C is performed when the stapling is executed at the stapling position C. The two-center binding is performed when the stapling is executed at the stapling positions Ab and Ac. With respect to the two-center binding, the stapler 260 first executes the stapling at either of the stapling position Ab or the stapling position Ac. Then, the stapler 260 moves to the other stapling position to which the stapling has not been performed yet.

Next, the stapler 260 and a movement of the stapler 260 will be described in reference to FIGS. 3*a*-3*b*, FIG. 4, FIG. 5 and FIG. 6.

Figure 4:
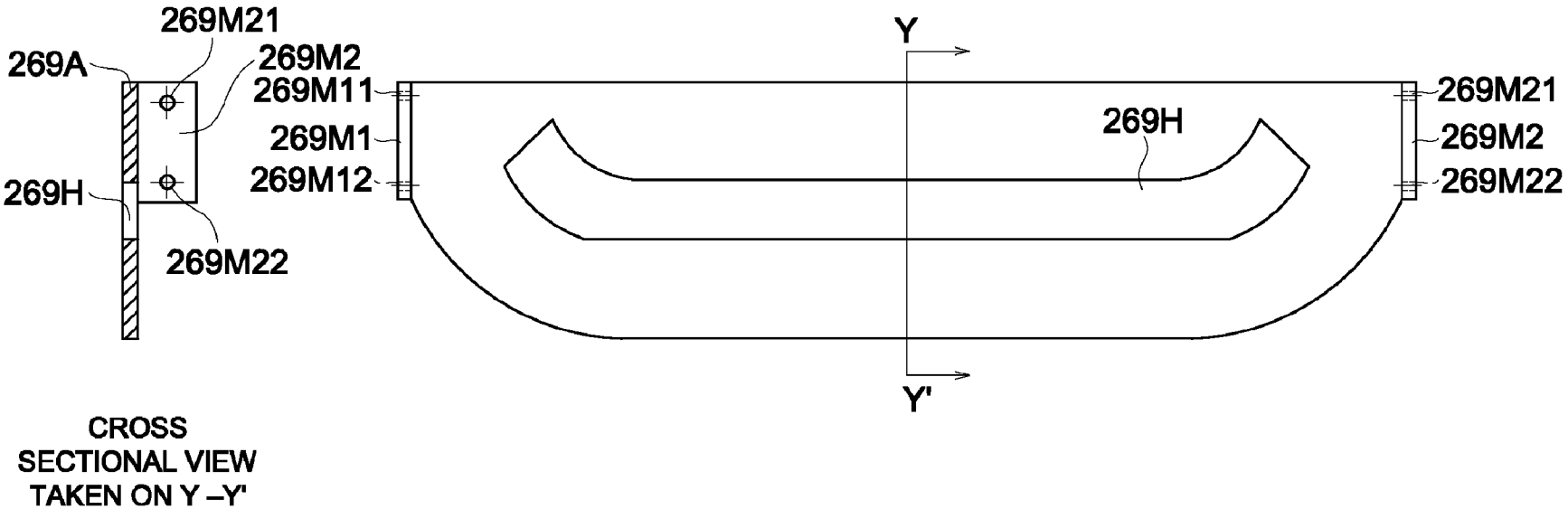
FIG. 4 illustrates a top view of a stapler holding substrate 269.
Figure 5:
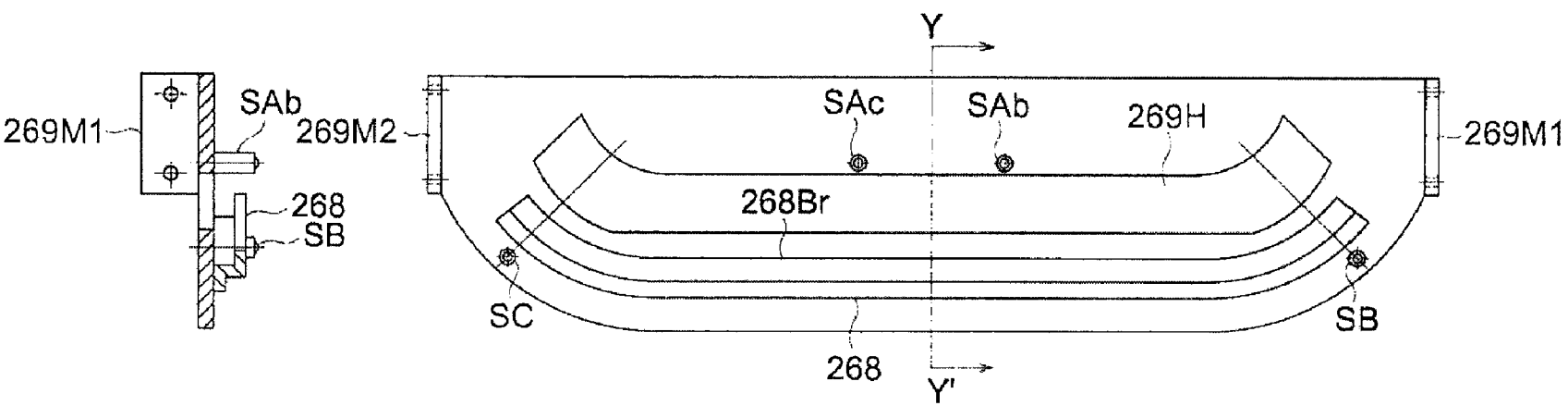
FIG. 5 illustrates a bottom view of the stapler holding substrate 269.
Figure 6:
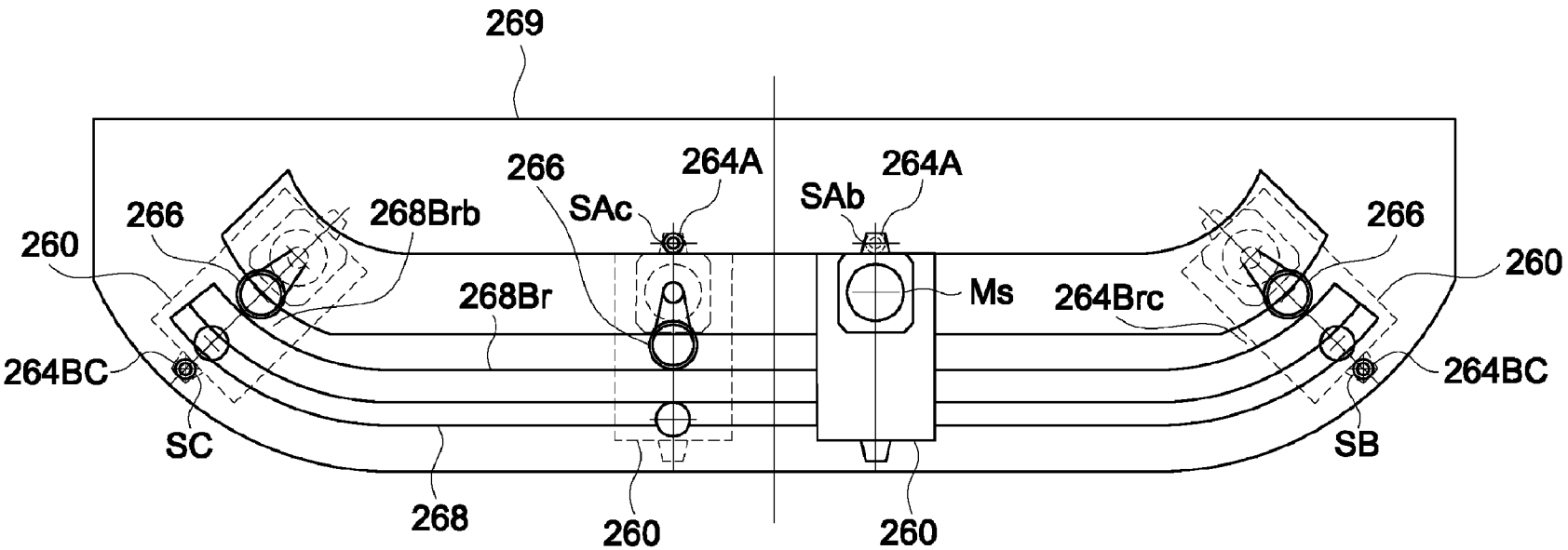
FIG. 6 illustrates a position of the stapler 260 on the stapler holding substrate 269.

FIG. 4 illustrates a top view of a stapler holding substrate 269. FIG. 5 illustrates a bottom view of the stapler holding substrate 269. FIG. 6 illustrates a position of the stapler 260 on the stapler holding substrate 269.

The stapler 260 is configured by a stapling mechanism section 261, a moving mechanism section 263 and a connecting member 262 for connecting the stapling mechanism section 261 and the moving mechanism section 263. The stapling mechanism section 261 and the moving mechanism section 263, which are connected by the connecting member 262, are arranged to sandwich the stapler holding substrate 269, and are arranged to move along the surface of the stapler holding substrate 269.

The stapling mechanism section 261 is configured by a staple cartridge 261A and a receiving section 261B. The stapling mechanism 261 staples the bundle of sheets Ss on the stacker 250 by having the staple cartridge 261A rotate from a state illustrated in broken line to a state illustrated in a solid line. At the time when the staple cartridge 261A performs the stapling at a stapling position, a part of the sheet rear end stopper 250E of the stacker 250 is cutout so that the staple cartridge 261A does not interfere with the sheet rear end stopper 250E (refer to FIG. 2).

The moving mechanism section 263 includes a stepping motor Ms as a stapler moving method, a drive gear 266 and a pressing roller 267. A rotating shaft of the stepping motor Ms penetrates a moving mechanism holding substrate 264. The rotating shaft that has penetrated and the drive gear 266 are connected by a timing belt 265.

The drive gear 266 is rotated by the rotation of the stepping motor Ms. The drive gear 266 is a gear whose circumference is toothed. The tooth is formed so that the tooth on the drive gear 266 engages with a rack tooth surface 268Br of a rack 268 illustrated in FIG. 5 and FIG. 6.

In case when the stapler 260 is attached to the stapler holding substrate 269, the drive gear 266 and the rack 268 engage with each other. In case when the drive gear 266 is rotated by the rotation of the stepping motor Ms, the drive gear 266 moves along the rack tooth surface 268 Br of the rack 268. Thus, the moving mechanism section 263 functions as a stapler moving section which moves the stapler 269. The pressing roller 267 contacts a wall surface 268Bh of the rack 268 when the drive gear and the rack tooth surface 268Br engage. Then while the engagement of the drive gear 266 and the rack tooth surface 268Br is maintained, the position of the stapler 260 is maintained orthogonal to the rack tooth surface 268Br at all times.

264A and 264BC are stapler position detection plates, and are fixed to the moving mechanism section substrate 264. The stapler position detection plates 264A and 264BC will be mentioned later.

FIG. 4 illustrates a top view of a stapler holding substrate 269.

The stapler holding substrate 269 is a plate having attaching sections 269M1 and 269M2 at both ends. The stapler holding substrate 269 is fixed to the sheet post-processing apparatus 200 via attachment holes 269M11 and 269M12 and attachment holes 269M21 and 269M22, which are arranged on the attaching sections 269M1 and 269M2.

An elongate hole 269H whose middle section is straight and both ends are curved is formed on the stapler holding substrate 269. The connecting member 262 penetrates the elongate hole 269H. Thus, the stapling mechanism section 261 and the moving mechanism section 263 arranged on the back and front of the stapler holding substrate 269 are capable of moving along the later mentioned rack 268.

As illustrated in FIG. 5, the rack 268, a sensor SB, a sensor SAb, sensor SAc and Sensor SC are attached on the bottom surface of "268SB". The sensor SB, the sensor SAb, the sensor SAc and the sensor SC detect that the stapler is in a predetermined position of the stapling position B, the stapling position Ab, the stapling position Ac and the stapling position C, respectively. These sensors SB, SAb, SAc and SB set the stepping motor Ms to a predetermined position.

FIG. 6 illustrates a diagram of the stapler 260 being moved to each stapling position illustrated from the moving mechanism section 263 side.

The stapler 260 attached to the stapler holding substrate 269 moves along the rack tooth surface 268 Br by the drive of the stepping motor Ms.

In case when the drive gear 266 of the stapler that moves along the rack tooth surface 268Br reaches to the position where the drive gear 266 engages with a curved section 268Brb illustrated on the right hand side of the figure, the stapler 260 moves in arch along the curved section 268Brb. The position of the stapler position detection substrate 264BC of the stapler 260 moving in arch is detected by the sensor SB is the stapling position B. In case when the stapler 260 performs a stapling at the stapling position B, the corner binding B is performed.

In case when the drive gear 266 of the stapler 260 that moves along the rack tooth surface 268Br reaches to the position where the drive gear 266 engages with a curved section 268Brb illustrated on the left hand side of the figure, the stapler 260 moves in arch along the curved section 268Brb. The position of the stapler position detection substrate 264BC of the stapler 260 moving in arch is detected by the sensor SC is the stapling position C. In case when the stapler 260 performs a stapling at the stapling position C, the corner binding C is performed.

The position of the stapler position detection substrate 264A of the stapler 260 is detected by the sensor SAb is at the stapling position Ab. In the similar manner, the position of the stapler position detection substrate 264A of the stapler 260 is detected by the sensor SAc is at the stapling position Ac.

The two-center binding is performed in case when the stapling is performed at two positions of the stapling position Ab and the stapling position Ac. With respect to the two-center binding, the stapler 260 first executes the stapling at either of the stapling position Ab or the stapling position Ac. Then, the stapler 260 moves to the other stapling position to which the stapling has not been performed yet.

There may be a case in which a staple jam occurs in the stapler 260.

The staple jam is a failure in which a staple is not properly punched out from the staple cartridge 261A when the bundle of sheets is stapled, and the staple remains at an irregular position in the staple cartridge 261A.

As illustrated in FIG. 3*a* and as mentioned above, a stapling operation is an operation in which the staple cartridge 261A is rotated to the solid line from the broken line of FIG. 3*a*.

This operation is performed by the drive of a motor. However, in case when abnormal strain is applied to the motor, a motor current detection device being a staple jam detection section detects the abnormal strain and the staple jam is detected.

In case when the staple jam occurs, the stapler 260 is moved to the stapling position B of FIG. 2 by the drive of the stepping motor Ms. The stapling position B is set at a position of the near side of the sheet post-processing apparatus 200. The stapling position B is also set at an access position that enables the operator to access the stapler in case when the open-close door arranged on the front side (near side of the sheet surface in FIG. 1) of the sheet post-processing apparatus 200 is opened.

That is, in case when the stapler 260 is at the stapling position B of FIG. 2, the operator is able to reach the stapler 260 without inserting a hand inside the sheet post-processing apparatus 200.

The staple cartridge 261A of the stapler 260 illustrated in FIG. 3 is configured of a staple cartridge in which a plurality of staples is stored. The staple cartridge 261A is detachably attached to the stapler 260.

In case of the staple jam, in other words, in case when the staple remains at the irregular position in the staple cartridge 261A, the staple cartridge 261A is taken out from the stapler 260 and the staple remaining at the irregular position is removed from the staple cartridge 261A taken out.

[Control at the Time of the Staple Jam Occurrence]

A control performed by the sheet post-processing apparatus 300 at the time of the staple jam occurrence will be described in reference to FIG. 8 to FIG. 12.

A staple jam clearance is performed by the operator as mentioned above. However, in order to perform such staple jam clearance, the stapler 260 needs to be moved to a position accessible by the operator at the time of the staple jam occurrence.

Figure 8:
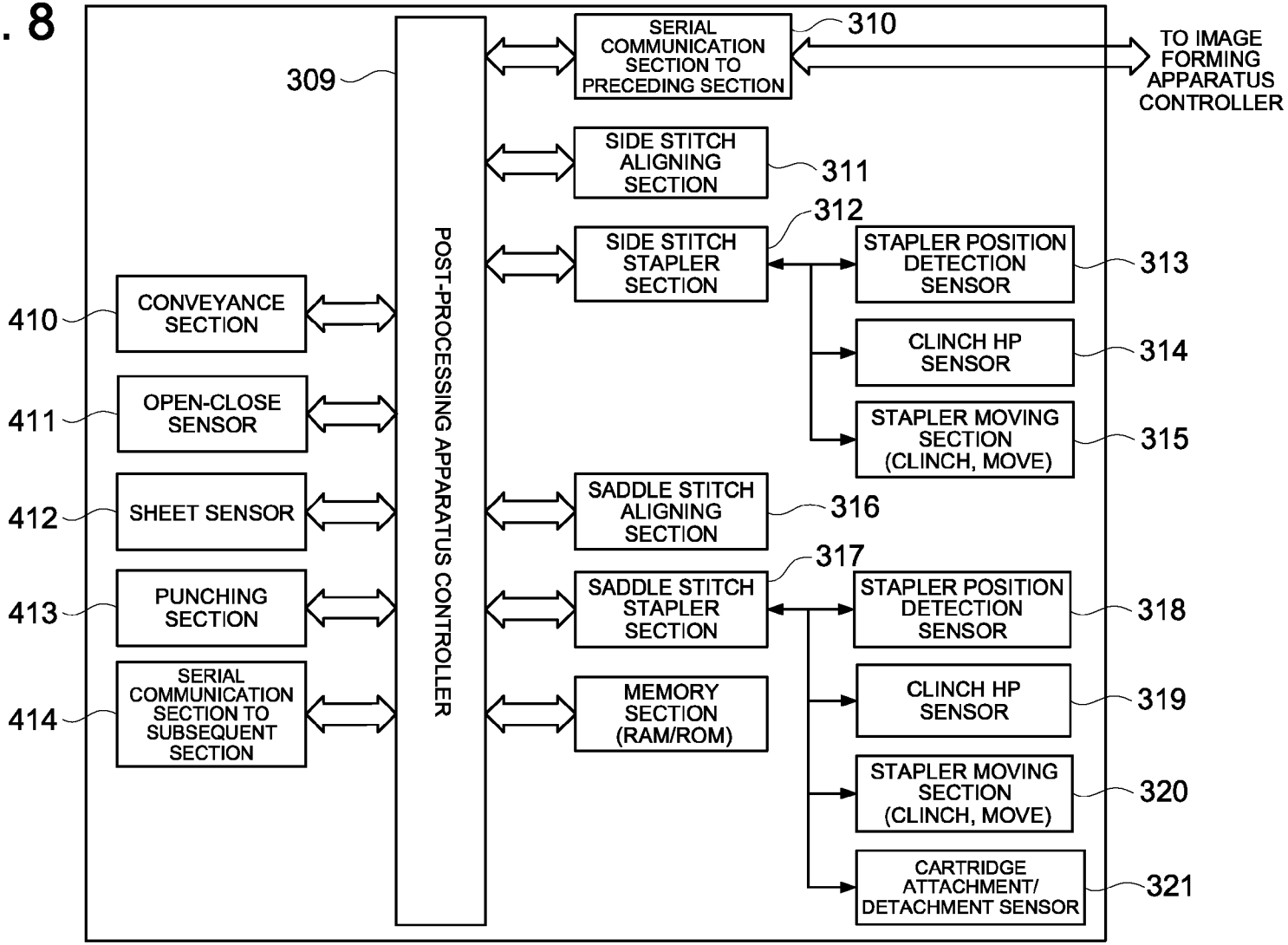
FIG. 8 illustrates a block diagram of a control system of the sheet post-processing apparatus pertaining to an embodiment of the present invention.

FIG. 8 illustrates a block diagram of a control system of the sheet post-processing apparatus.

A post-processing apparatus controller 309 being a control device communicates with an image forming apparatus controller for controlling the image forming apparatus 100 and the entire image forming system illustrated in FIG. 1 via serial communication section to a preceding section 310.

That is, the post-processing apparatus controller 309 acquires various information including a content of a post-processing from the image forming apparatus controller and performs a condition setup of each processing section in the sheet post-processing apparatus 200. The post-processing apparatus controller 309 also reports each status of the sheet post-processing apparatus 200 to the image forming apparatus controller.

"311" is an aligning section for aligning the sheet on the stacker 250 in FIG. 1. "312" is a side stitch stapler section for performing a staple processing by the stapler 260 in FIG. 1.

The side stitch stapler section 312 includes a stapler position detection sensor 313 for detecting the position of the stapler 260, a clinch HP sensor 314 for detecting a home position of the staple cartridge in the stapling operation and a stapler moving section 315 for moving the staple cartridge and performing the stapling.

In the similar manner, a saddle stitch stapler section 317 also includes a stapler position detection sensor 318, a clinch HP sensor 319, and a stapler moving section 320 which controls the drive of the saddle stitch stapler 215 in FIG. 1.

The saddle stitch stapler section 317 also includes a cartridge attachment/detachment sensor 321 for detecting the attachment and detachment of the staple cartridge.

An attachment and detachment of the staple cartridge 261A to and from the stapler 260 in FIG. 3 is detected by the cartridge attachment/detachment sensor 321. The sensor for detecting the attachment and detachment is turned on when the staple cartridge 261 is detached from the stapler 260. The sensor for detecting the attachment and detachment is turned off when the staple cartridge 261A is attached to the stapler 260.

"410" is a conveyance section for conveying the sheet through conveyance paths r1-r5 in FIG. 1. "411" is an open-close sensor for detecting the opening and closing of the open-close door of the sheet post-processing apparatus 200. The open-close sensor 411 detects "open" and "close" separately. For example, the sheet post-processing controller 309 detects an operation of the open-close door opening and closing based on an output of the open-close sensor 411.

"412" is a sheet sensor for detecting an existence of the sheet in the conveyance path in FIG. 1. In FIG. 1, a sheet sensor SE1 arranged at a sheet introduction section of the sheet post-processing apparatus 200, a sheet sensor SE2 arranged to detect the existence of the sheet at the sheet discharge section to the stacker 250 from the conveyance path r3 and r4, a sheet sensor SE3 arranged to detect the existence of the sheet on the stacker 250 and a sheet sensor SE4 arranged to detect the existence of the sheet in the saddle stitch section are provided as a sheet sensor. A sheet sensor 412 includes these sheet sensors SE1-SE4.

"413" is a punching section being a drive section of the puncher 210. "414" is a serial communication section to subsequent section for communicating with the sheet post-processing apparatus connected to the subsequent section of the sheet post-processing apparatus 200 in FIG. 1.

Figure 9:
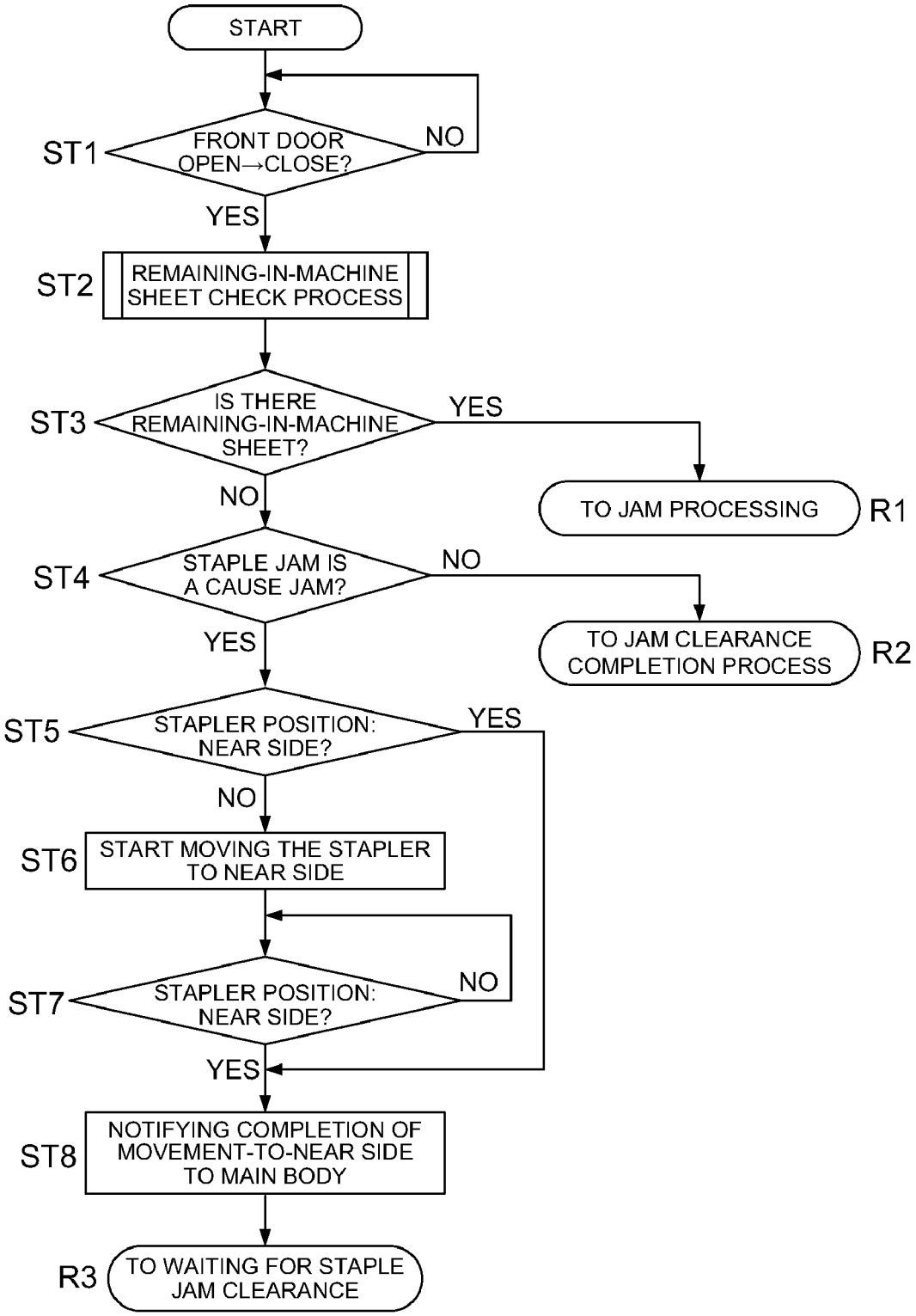
FIG. 9 illustrates a flow chart of a control when a staple jam has occurred.

FIG. 9 illustrates a flow chart of a control when the staple jam has occurred.

In the control illustrated in FIG. 9, in case when the staple jam causes the apparatus to stop, the operator opens the open-close door of the sheet post-processing apparatus 200 and removes a remaining-in-machine sheet. After the remaining-in-machine sheet has been removed, the operator closes the open-close door. In case when such operation is complete, the stapler 260 is moved to the access position of the open-close door side.

The control illustrated in FIG. 9 starts when the staple jam detecting section detects the staple jam.

In STEP ST1, an opening of the open-close door and a closing that follows the opening of the open-close door of the sheet post-processing apparatus 200 is checked (open→close). In case when open→close is detected, whether a sheet is remaining in the sheet post-processing apparatus or not is determined in STEP ST2.

As described above, the sheet sensors SE1-SE4 are provided in the sheet post-processing apparatus 200. The determination of STEP ST2 is performed to prevent a complication of the staple jam process in which the stapler 260 is caught by the sheet when moving the stapler 260 to the near side of the open-close door side being the access position, from the far side of the apparatus being the home position.

Therefore, with respect to investigation performed in STEP ST2, at least the output of the sheet sensor SE3, that is, a sensor for detecting the existence of the remaining-in-machine sheet in the stacker 250 needs to be checked.

However, all of the sheet sensors SE1-SE4 in the apparatus may detect the existence of the remaining-in-machine sheet.

In case when the remaining-in-machine sheet is detected by a sheet sensor in STEP ST2 (YES on ST3), the process proceeds to a jammed sheet processing routine R1 (not illustrated).

This jam sheet processing routine R1 is a control for detecting the sheet in the sheet post-processing apparatus, for prompting the operator to remove the remaining-in-machine sheet by displaying a location of the remaining sheet on the operation display section 170, and for continuing to perform a remaining-in-machine sheet detection until there is no the remaining-in-machine sheet.

In case when the remaining-in-machine sheet is not detected (No at ST3), whether a jam is the staple jam or not is checked (ST4).

In case when the jam is not the staple jam, since the jam is not the staple jam or the sheet jam, the process moves to a completion of jam clearance (R2).

In case when the jam is the staple jam (YES on ST4), whether the stapler 260 is at the near side position, namely, the stapling position B or not is checked (ST5). In case when the stapler 260 is set at the stapling position B, the process moves to STEP ST8.

In case when the stapler 260 is not at the stapling position B, the motor Ms is operated and the stapler 260 is moved to the stapling position B (ST6 and ST7).

In case when the stapler 260 is detected to be positioned at the stapling position B in the near side, after the image forming apparatus controller is notified of the position of the stapler 260 to be at the stapling position B (ST8), the process moves to a staple jam clearance waiting routine R3 that will be described below.

In a state of waiting for the clearance of the staple jam, a message reading "remove the stapler causing the jam" is displayed on the operation display section 170 of the image forming apparatus.

Figure 10:
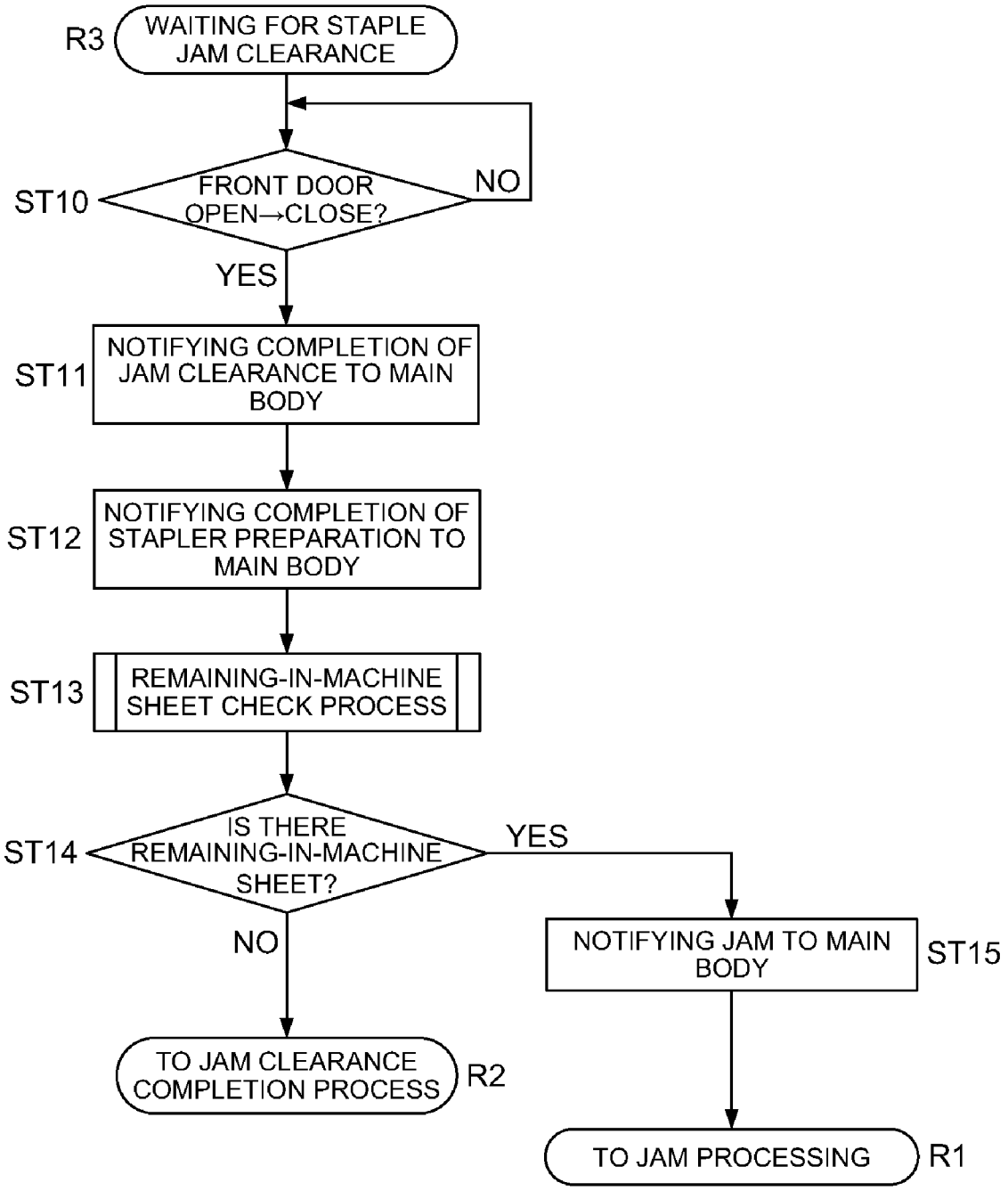
FIG. 10 illustrates a routine R3 for waiting for the staple jam to be cleared.

FIG. 10 illustrates the staple jam clearance waiting routine R3.

The staple jam clearance waiting is for determining whether the clearance of the staple jam performed by the operator is completed or not.

In STEP ST10, whether the open-close door has been closed after the open-close door on the near side of the sheet post-processing apparatus 200 has been opened is checked. This is a process for detecting that the operator has accessed the stapler 260.

That is, it is determined that the operator has accessed the stapler 260 when the open-close door has been closed after being opened.

The staple jam clearance is assumed to have been performed by the opening and closing of the open-close door in a state in which the stapler 260 has been moved to the near side position (a state in which the flow of FIG. 9 has been completed) at the time of the staple jam occurrence. Then the staple jam clearance is notified to the image forming apparatus controller (ST11). The staple jam clearance is referred to a state in which the staple cartridge 261A is once detached from the stapler 260, the staple, which has not been properly stapled and is remaining in the staple cartridge 261A, is removed, and the 261A is again attached to the stapler 260.

The completion of stapler preparation is notified to the image forming apparatus controller (ST12).

Following STEP ST12, the existence of the remaining-in-machine sheet in the sheet post-processing apparatus 200 is checked again (ST13). STEP ST13 is performed by supervising the output of the sheet sensor SE3.

In case when there is the remaining-in-machine sheet, the image forming apparatus controller is notified of the existence of the remaining-in-machine sheet (ST15) and the process proceeds to the above mentioned jam sheet processing R1.

On the other hand, in case when there is no remaining-in-machine sheet, the process proceeds to the jam clearance completion process routine R2 (not illustrated).

In the jam clearance completion routine R2, a process, such as setting the stapler 260 to the home position at the far side of the apparatus and canceling an operation prohibition of a various drive members of the motor, is performed.

FIG. 10 illustrates a control of a case in which the stapler 260 does not include the staple cartridge attachment and detachment sensor for detecting the attachment and the detachment of the staple cartridge 261A.

Figure 11:
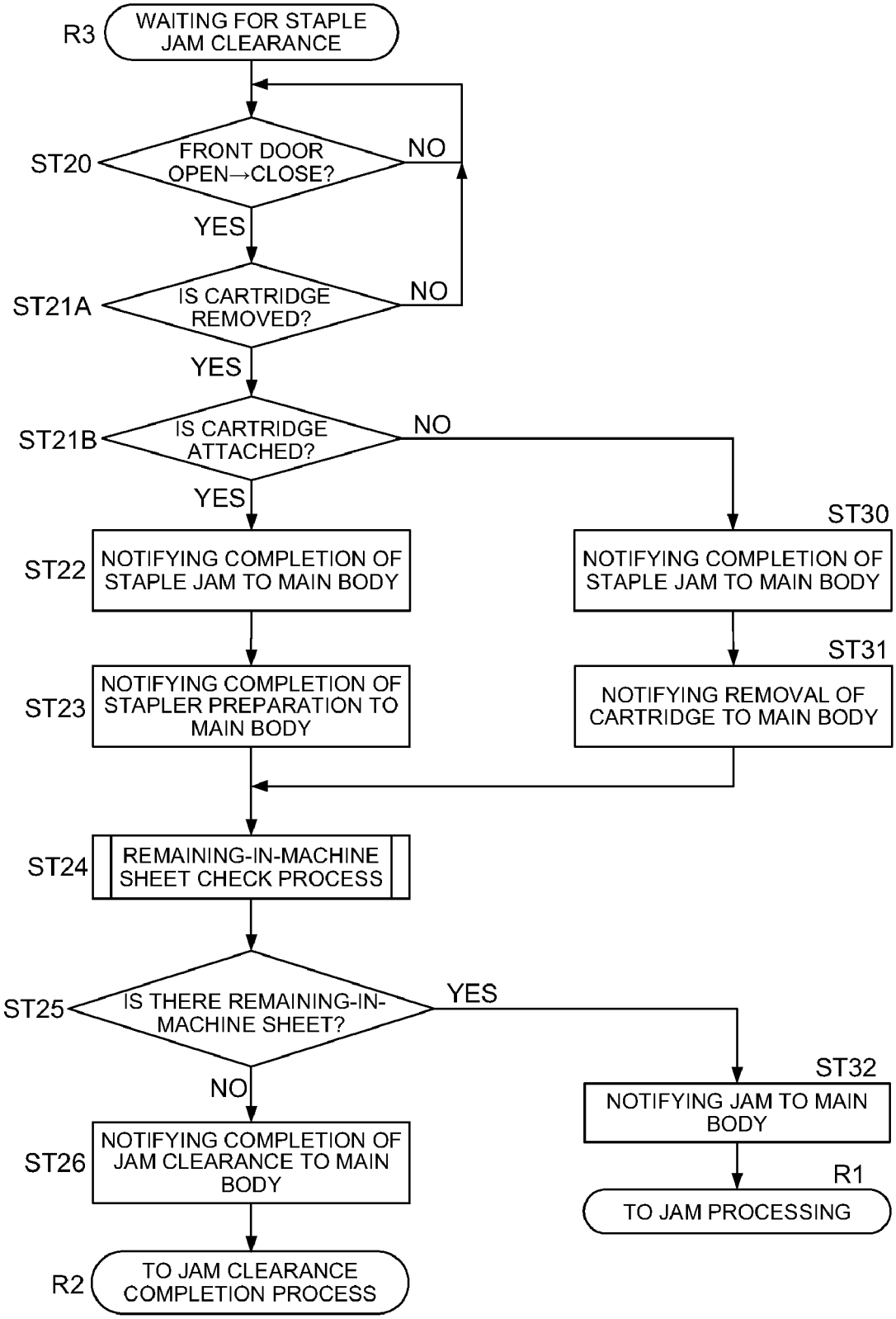
FIG. 11 illustrates the routine R3 for waiting for the staple jam to be cleared.

On the other hand, FIG. 11 illustrates the control of the staple jam clearance waiting in case when the stapler 260 includes the staple cartridge attachment and detachment sensor for detecting the attachment and detachment of the staple cartridge 261A.

For example, the stapler 260 used in FIG. 11 is turned on when the staple cartridge 261A is detached and is turned off when the staple cartridge 261A is attached.

In STEP ST20, whether the open-close door of the sheet post-processing apparatus 200 has been closed after being opened is checked. This process is for detecting that the operator has accessed the stapler 260.

In case when open→close is detected (YES on ST20), the attachment and detachment of the staple cartridge 261A, namely, of the stapling section is checked.

There are the following three cases regarding the attachment and detachment of the staple cartridge 261A.

That is, there are a case in which the attachment of the staple cartridge 261A is performed following the detachment of the staple cartridge 261A, a case in which only the detachment of the staple cartridge 261A is performed without the attachment of the staple cartridge 261A and a case in which the detachment of the staple cartridge 261A is not performed.

In case when the detachment of the staple cartridge 261A is not performed (NO on ST21A), the process waits for the detachment to be performed. In case when it is determined to be No on ST21A, the process returns to the STEP before STEP ST20 and waits for the open→close of the open-close door again.

In case when the detachment of the staple cartridge 261A is performed and not the attachment (No on ST21B), the staple jam clearance completion and the staple cartridge 261A omission are notified to the image forming apparatus controller (ST30 and ST31).

In case when the attachment of the staple cartridge 261A is performed (Yes on ST21B), the staple jam clearance completion and the stapler preparation completion are notified to the image forming apparatus controller (ST22 and ST23).

The notification of STEPS ST22 and ST23 is the staple jam clearance notification.

Thus, in case when the attachment of the staple cartridge 261A is performed (Yes on ST21B) and in case when the attachment of the staple cartridge 261A is not performed (No on ST21B), in either case, in the post-processing apparatus, the process proceeds as the staple jam has been completed (ST22 and ST30).

In case when the cartridge omission of ST31 is notified to the image forming apparatus controller, the image forming apparatus controller displays a message reading, "attach the staple cartridge" on the operation display section 170, and interrupts a job until the staple cartridge 261A is attached.

After STEP ST23, the check of the remaining-in-machine sheet is performed again (ST24).

In case when there is no remaining-in-machine sheet (No on ST25), the jam clearance completion is notified to the image forming apparatus controller (ST26).

Then the jam clearance completion process is performed (R2).

In case when there is the remaining-in-machine sheet (Yes on ST25), the jam is notified to the image forming apparatus controller (ST32) and the process proceeds to the above mentioned jam processing routine R1.

As illustrated in FIG. 9, in case when the staple jam has been detected, the open-close door has been closed after being opened and the remaining-in-machine sheet has not been detected, the stapler 260 moves to the access position of near side from the home position on the far side of the sheet post-processing apparatus.

With respect to a normal operation, the opening and closing operation of the open-close door is not performed while the stapler 260 is in movement. However, in case when an irregular operation is performed, there is a case in which the front door is opened while the stapler 260 is moving to the access position on the near side from the home position on the far side of the apparatus. In such a case, in order to secure the safety, the movement of the stapler 260 is stopped immediately.

Figure 12:
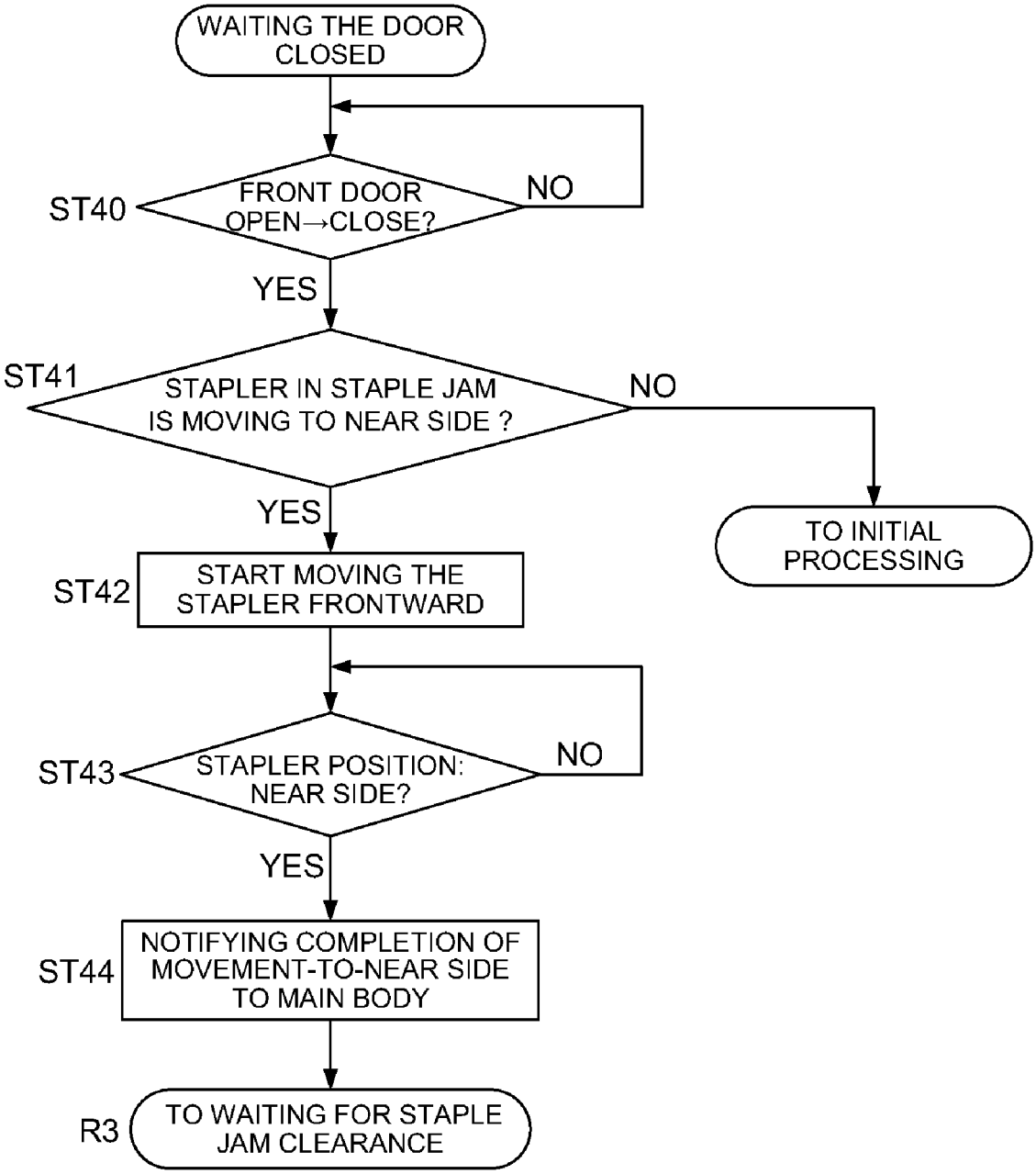
FIG. 12 illustrates a flow chart of the control when a front door opens while the stapler is in movement.

FIG. 12 illustrates a control for securing the safety against such irregular operation.

In STEP ST40, whether the open-close door has been closed (open→close) is checked.

In case when the open-close door has been closed, whether the stapler 260 is in movement or not is checked in STEP ST41. This is checked by monitoring the output of the stapler position sensor section 313 in FIG. 8.

In case when the stapler 260 is in movement (Yes on ST41), an operation is started for moving the stapler 260 to the near side (ST42). In case when the stapler 260 reaches to the access position (Yes on ST43), the image forming apparatus controller is notified of the stapler movement completion (ST44). Then the process proceeds to the staple jam clearance waiting routine R3.

In case when the determination of STEP ST14 shows that the stapler 260 is not in movement, namely, in case when the stapler 260 is at the home position, the process returns to "START" in FIG. 9.

The present invention is not limited to the above-mentioned embodiment. For example, the stapling position B of a stapler does not need to be at the same position as the access position. The access position may be arranged at a position that is closer to the open-close door than the stapling position B. In the similar manner, the stapling position C does not need to be at the same position as the home position. The home position may be arranged on the farther side of the apparatus than the stapling position C. The stapler is not limited to the stapler that is arranged to return to the home position once and move to the access position after the remaining-in-machine sheet in the apparatus has been removed. The stapler may be arranged to move directly to the access position from the either of the stapling position. The stapler is not limited to the side stitch stapler. The present invention can be applied to the saddle stitch stapler or as long as the stapler is arranged with a method of moving and stapling in the sheet width direction.

According to the present embodiment, it is possible to access the stapler only by the operation of opening the open-close door. Also at the time of staple jam occurrence, the stapler securely moves to the access position.

Therefore, the sheet post-processing apparatus and the image forming system having a good operability of the staple jam clearance, having a small occupational area of the apparatus and having a low cost and the image forming system can be realized.

What is claimed is:

1. A sheet post-processing apparatus comprising:

an open-close door arranged to be capable of being opened and closed;

a stapler which executes a staple processing to a bundle of sheets;

a staple jam detection section which detects a staple jam where a staple is not properly punched out from the stapler;

a stapler moving section which moves the stapler to an access position disposed close to the open-close door;

a stacker which holds the bundle of sheets to be stapled;

a sheet sensor which detects at least whether a sheet exist on the stacker; and a controller which controls the stapler moving section, wherein when the staple jam detection section detects a staple jam and the sheet sensor detects that there is no sheet on the stacker, the controller controls to operate the stapler moving section to move the stapler from a home position to the access position, and wherein, when the staple jam detection section detects the staple jam and the sheet sensor detects the sheet on the stacker, the controller prevents the stapler from moving to the access position.

2. The sheet post-processing apparatus of claim 1, wherein the home position of the stapler is set on a far side of an apparatus which is an opposite side of the open-close door with respect to the access position.

3. The sheet post-processing apparatus of claim 1, further comprising an open-close sensor for detecting an opening and a closing of the open-close door, wherein the controller operates the stapler moving device to move the stapler to the access position upon a condition where the open-close sensor detects that the open-close door has been opened and thereafter closed.

4. The sheet post-processing apparatus of claim 3, wherein in a condition that the stapler is set to the access position, when the open-close sensor detects the opening and thereafter the closing of the open-close door, the controller determines that staple jam has been cleared, and clears a staple jam state.

5. The sheet post-processing apparatus of claim 3, wherein the controller controls the stapler moving section to stop the stapler when the opening of the open-close door is detected while the stapler is being moved by the stapler moving section, and after stopping the stapler, the controller controls the stapler moving section to move the stapler to the access position when the closing of the open-close door is detected by the open-close sensor.

6. The sheet post-processing apparatus of claim 1, further comprising a cartridge attachment and detachment sensor for detecting attachment and detachment of a staple cartridge of the stapler, the control device clears a staple jam state when the cartridge attachment and detachment sensor detects detachment and attachment of the staple cartridge.

7. An image forming system comprising:

an image forming apparatus for forming an image on a sheet; and the sheet post-processing apparatus of claim 1 for executing staple processing to the bundle of sheets containing a plurality of sheets on which the image forming apparatus has formed images.

* * * * *